US005325955A

United States Patent [19]

Ahls et al.

[11] Patent Number: 5,325,955

[45] Date of Patent: Jul. 5, 1994

[54] ESCALATOR STEP CHAIN SUPPORT APPARATUS

[75] Inventors: Hermann W. Ahls, Obernkirchen OT Vehlen; Martin Mehlert, Nienstaedt; Jan G. Harbers, Ahnsen, all of Fed. Rep. of Germany

[73] Assignee: Otis Elevator Company, Farmington, Conn.

[21] Appl. No.: 134,036

[22] Filed: Oct. 8, 1993

[51] Int. Cl.[5] ..... B66B 23/12

[52] U.S. Cl. ..... 198/332; 198/326

[58] Field of Search ..... 198/321, 326, 327, 329, 198/331, 332

[56] References Cited

U.S. PATENT DOCUMENTS 2,231,709 2/1941 Dunlop ..... 198/332 X
2,656,031 10/1953 Masek ..... 198/332
2,686,585 8/1954 Margles et al. ..... 198/332
5,137,135 8/1992 Pietsch et al. ..... 198/332

FOREIGN PATENT DOCUMENTS 1135637 8/1962 Fed. Rep. of Germany ..... 198/332
5-43180 2/1993 Japan .
1618725 1/1991 U.S.S.R. ..... 198/332

*Primary Examiner*—D. Glenn Dayoan

[57] ABSTRACT

An apparatus for supporting the step chain of an escalator having a frame with a first and a second landing, an inclined section attached therebetween, and roller tracks fixed thereto, is provided and includes a pair of arcuated ramps for supporting the step chain in a transition area between either of the landings and the inclined section, inboard of the roller tracks, each of the ramps is made of a first bushing, a second bushing, and an elastomeric center section attached to the bushings.

5 Claims, 2 Drawing Sheets

ESCALATOR STEP CHAIN SUPPORT APPARATUS

BACKGROUND OF THE INVENTION

1. Technical Field

This invention pertains to escalators in general, and to escalators driven by step chains in particular.

2. Background Art

Escalators are a known method for conveying people from a first elevation to a second elevation. Typically, an escalator includes a frame, a drive, a step chain and a pair of balustrade assemblies. The frame comprises a truss section on both the left and right hand sides of the frame. Each truss section has two end sections forming landings, connected by an inclined midsection. Matching pairs of roller tracks are attached on the inside of each truss section, i.e. the side of the truss section facing the other truss section. The upper landing usually houses the escalator drive between the trusses. The drive powers a pair of step chain sprockets, which in turn impart motion to the step chain. The step chain travels a closed loop, running from one elevation to the other elevation, and back.

Step chains typically consist of a pair of chain strands connected by a plurality of axles, each axle having a pair of rollers which contact the roller tracks. The chain strands are attached to the axle inside of the rollers. Each strand is formed from a plurality of chain links. Each link has a pair of side plates spaced apart from one another, pivotly attached to the side plates of the adjacent links of the strand. This link arrangement is repeated as many times as is necessary to arrive at the length strand, and therefore the length chain desired. The axles connect every "$n^{th}$" link in one of the strands to the aligned link in the other strand. Connecting the strands with the axles ties the two independent strands into a single step chain.

The load on each step chain axle may be described as having two main components: the load on the attached treadplate and the load transferred through the attached chain strands. The load attributable to the attached treadplate is simply the weight of the treadplate and whatever load is on that treadplate. The axle receives this load where the treadplate is attached to the axle, inboard of the rollers. The load attributable to the attached chain strands, on the other hand, is a function of the step chain sprockets pulling the chain, and therefore includes a percentage of all of the individually loaded treadplates, along the inclined midsection. Both of these loads on the step chain axle are transferred to the rollers attached to the axles, outboard of the chain strands. Each axle, therefore, can be viewed as a beam simply supported at each end by a roller. The chain strands and the attached steps, both inboard of the rollers, can be viewed as loads on the beam. If the loads are great enough, the beam will deflect due to the position of the loads on the beam.

A person of skill in the art will recognize that while a step chain may be constantly loaded, the load on each step axle will vary depending on the position of the axle along the circuitous path taken by the step chain. Specifically, it is known that a particular step chain axle will experience a greater load in the transition area between the inclined section and the upper landing when the exposed side of the step chain loop is traveling up the incline, than it will in any other section of the step chain travel path. As a result, the step axles deflect a greater amount in this area, thereby causing increased wear on the axles and bearings supporting the rollers.

The undesirable axle deflection can be eliminated by using larger axles, or by using axles fabricated from stronger materials. These solutions, however, increase the cost of the step chain significantly. Moreover, in many cases these solutions are not practical for existing escalators. What is needed, therefore, is an apparatus for supporting the step chain of an escalator.

DISCLOSURE OF THE INVENTION

It is, therefore, an object of the present invention to provide an apparatus for supporting the step chain of an escalator which minimizes the wear on the step chain, without increasing the cost of the chain.

It is a further object of the present invention, to provide an apparatus for supporting the step chain of an escalator which minimizes vibration propogating through to the treadplates attached to the step chain.

It is a still further object of the present invention, to provide an apparatus for supporting the step chain of an escalator which may be retrofitted onto existing escalators.

According to the present invention, an apparatus for supporting the step chain of an escalator having a frame with a first and a second landing, an inclined section attached therebetween, and roller tracks fixed thereto, is provided comprising a plurality of arcuated ramps for supporting the step chain in a transition area between either of said landings and the inclined section, inboard of the roller tracks, comprising a first bushing, a second bushing, and an elastomeric center section attached to said bushings.

According to an aspect of the present invention, bearing means attached to the step chain are provided for receiving the plurality of arcuated ramps.

An advantage of the present invention is that the life of the step chain is increased because the wear on the step chain is reduced.

A further advantage of the present invention is that the present invention may be retrofitted on to existing escalators.

A still further advantage of the present invention is that the present invention lowers the operational cost of the escalator by extending the life of the step chain.

BEST MODE FOR CARRYING OUT THE INVENTION

Figure 1:
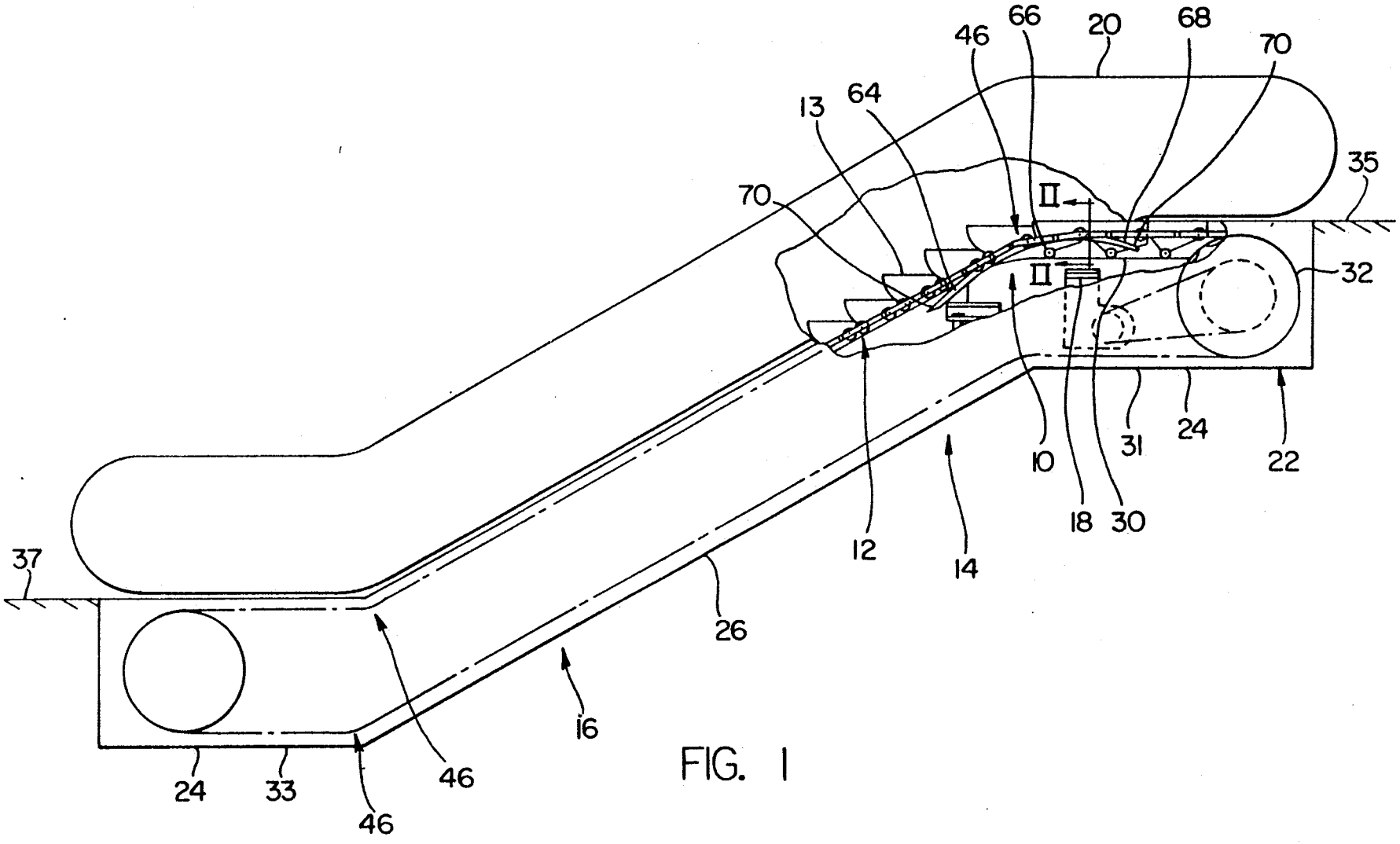
FIG. 1 is a diagrammatic profile of an escalator having a cutaway showing the step chain and means for supporting the step chain in the transition area between the inclined section and the upper landing.
Figure 2:
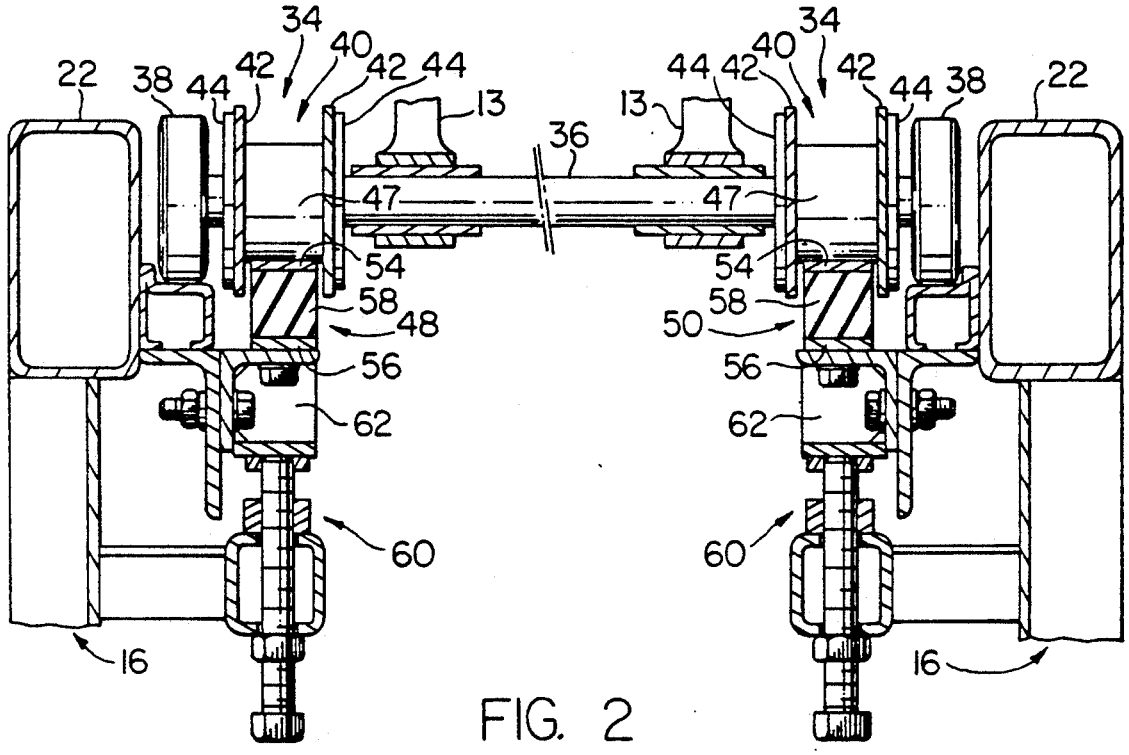
FIG. 2 is a cross-section of the step chain and means for supporting the step chain shown in FIG. 1.

Referring to FIGS. 1 and 2, an apparatus 10 for supporting the step chain 12 of an escalator 14 is shown installed in an escalator 14 The escalator 14 comprises a frame 16, a drive 18, a step chain 12, a plurality of treadplates 13, and a pair of balustrade assemblies 20 as is known in the art.

The frame 16 comprises a truss section 22 (see FIG. 2) on both the left and right hand sides of the frame 16. Each truss section 22 has two end sections 24 (see FIG. 1) parallel to one another, connected by an inclined midsection 26. The end sections 24 form an upper landing 31 at the upper elevation 35 and a lower landing 33 at the lower elevations 37. Matching pairs of roller tracks 30 are attached on the inside of each truss section 22, i.e. the side of the truss section 22 facing the other truss section 22. The area between the inclined midsection 26 and a landing 31,33 in which the slope of the roller track 30 is changing from the slope of the incline 26 to that of the landing 31,33, is defined to be the transition area 46 between the inclined midsection 26 and either of the landings 31,33.

The upper landing 31 houses the escalator drive 18 (see FIG. 1), between the trusses 22. The drive 18 powers a pair of step chain sprockets 32, which in turn impart linear motion to the step chain 12. The step chain 12 travels a closed loop (shown in phantom in FIG. 1), running from one elevation to the other elevation, and back.

Now referring to FIG. 2, the step chain 12 comprises a pair of chain strands 34 connected by a plurality of axles 36, each axle 36 having a pair of rollers 38. The chain strands 34 are attached to each axle 36 inboard of the rollers 38. Each strand 34 is formed from a plurality of chain links 40. Each link 40 has a pair of side plates 42 spaced apart from one another, pivotly attached to the side plates 44 of the adjacent links of the strand 34. This link 40 arrangement is repeated as many times as is necessary to arrive at the length strand 34, and therefore the length chain desired. The axles 36 connect every "$n^{th}$" link in one of the strands 34 to the aligned link 40 in the other strand 34. In each link 40 connected by an axle 36, the apparatus 10 for supporting the step chain 12 in the transition areas 46 comprises a bearing 47 pivotly mounted on the axle 36 in between side plates 42 of the link 40.

The apparatus 10 for supporting the step chain 12 in the transition areas 46 further comprises a first 48 and second 50 arcuated ramp attached to the frame 16 in one of the transition areas 46 between the inclined midsection 26 of the frame 16 and the landings 31,33. The apparatus 10 may be installed in any of the four transition areas 46. Each arcuated ramp 48,50 comprises a first bushing 54, a second bushing 56, and an elastomeric center section 58. The elastomeric center section 58 is positioned between, and attached to, the first 54 and second bushings 56. The Gummi-Metall-Technik Corporation (GMT GmbH) of the Federal Republic of Germany offers a product having a first and second bushing, and an elastomeric center section which may be formed into the ramp. Laterally, the ramps 48,50 are aligned with the strands 34 of the step chain 12. Vertically, the height of each ramp 48,50 may be adjusted either toward or away from the step chain 12 by manipulating a jacking bolt assembly 60 fixed to the frame 16 on each side. The jacking bolt assembly 60 cooperates with a mounting flange 62 fixed to the second bushing 56 of each ramp 48,50.

Now referring to FIGS. 1 and 2, each arcuated ramp 48,50 has a profile defined by an entry section 64, a center section 66, and an exit section 68. When positioned within the frame 16, the entry sections 64 have curved surfaces 70 which begin below, and therefore out of contact with, the bearings 47 mounted within the passing strands 34. The curved surface 70 of each entry section 64 then extends upward and into a position where the above aligned bearing 47 will contact the ramp 48,50 as it passes by. Each entry section 64 then blends into the adjacent center section 66. The center section 66 of each ramp 48,50 comprises a geometry which maintains each bearing 47 mounted on the axle 36 in contact with aligned ramp 48,50. The center section 66 geometry typically mimics the roller track 30 geometry in this section, offset by a defined amount. The center section 66 then blends into the adjacent exit section 68, having a geometry opposite of the entry section 64. Specifically, the exit section 68 begins at the same height as the center section 66 and subsequently curves downward.

Referring to FIG. 1, in the operation of the escalator 14, the step chain 12 and attached treadplates 13 will be drawn either up or down the inclined midsection 26 between the two landings 31,33. If the step chain 12 is drawn up the midsection 26 (i.e. traveling from the lower landing 33 to the upper landing 31), the step chain 12 will encounter the step chain support apparatus 10 in the transition area 46 between the midsection 26 and the upper landing 31.

As the step chain 12 is drawn toward the support apparatus 10, the axle 36 will initially begin to pass over the entry section 64 of each ramp 31,33. Subsequently, the bearings 47 pivotly mounted on the axles 36 will contact the ramps 31,33, thereby causing the axle 36 to be supported by the ramps 31,33 rather than the roller tracks 30. The midsections 26 of the ramps 31,33 support the axle 36 throughout the transition area 46. The advantage of supporting the step axle 36 with the ramps 31,33 in the transition area 46 is the load due to the chain strands 34 passes directly through to the ramps 31,33. Hence, there is no moment arm which would cause the axle 36 to deflect if the load was great enough. Finally, the curved surface of each ramp exit section 68 lowers the step axle 36 back down into contact with the roller tracks 30.

A person of ordinary skill in the art will recognize that the mirror profiles of the entry 64 and exit 68 sections enable the apparatus 10 for supporting the step chain 12 to function regardless of which direction the step chain 12 is drawn.

Although this invention has been shown and described with respect to the detailed embodiments thereof, it will be understood by those skilled in the art that various changes in form and detail thereof may be made without departing from the spirit and scope of the claimed invention.

We claim:

1. A step chain support apparatus, for an escalator having a frame with a first landing, a second landing, and an inclined section attached therebetween, a step chain for travel along a predetermined path, having a plurality of axles with rollers, and a pair of roller tracks for supporting the step chain along the path, comprising:

a pair of arcuated ramps for supporting the step chain in a transition area between either of said landings and said inclined section, inboard of the roller tracks, wherein each of said ramps comprises a first bushing, a second bushing, and an elastomeric center section attached to said bushings.

2. An escalator according to claim 1, further comprising:

bearing means pivotly mounted on an axle of the step chain, wherein said arcuated ramps are received by said bearings means.

3. An escalator, comprising:

a frame, having a first landing, a second landing, and an inclined section attached therebetween;

a step chain, having a first strand and a second strand connected by a plurality of axles, each axle having a pair of pivotly attached rollers, for travel along a predetermined path;

a pair of roller tracks, for supporting said rollers and therefore said step chain along said path; and a pair of arcuated ramps for supporting said step chain in a transition area between either of said landings and said inclined section, inboard of said roller tracks, wherein each of said ramps comprises a first bushing, a second bushing, and an elastomeric center section attached to said bushings.

4. An escalator according to claim 3, wherein said step chain further comprises bearings pivotly mounted on said axles for receiving said arcuated ramps.

5. An escalator according to claim 3, wherein said step chain further comprises:

a first strand, having links pivotly attached to one another, each link comprised of a first side plate and a second side plate spaced apart from said first side plate;

a second strand, having links pivotly attached to one another, each link comprised of a first side plate and a second side plate spaced apart from said first side plate; and a plurality of bearings;

wherein said strands pivotly attach to said axles inboard of said rollers, and wherein one of said bearings is pivotly mounted on said axle between said side plates of said first strand, and another of said bearings is pivotly mounted on said axle between said side plates of said second strand, and wherein said bearings contact said ramps as said step chain is drawn through said transition area, thereby supporting said step chain in said transition area inboard of said roller tracks.

* * * * *